US006070376A

United States Patent [19]

Asper

[11] Patent Number: 6,070,376

[45] Date of Patent: Jun. 6, 2000

[54] INTERFITTING WOODEN AND LOG WALLS

[76] Inventor: William D. Asper, R.D. #1, Box 240, Rte. 150, Lock Haven, Pa. 17745

[21] Appl. No.: 09/146,441

[22] Filed: Sep. 3, 1998

[51] Int. Cl.[7] ..... E04B 1/10

[52] U.S. Cl. ..... 52/233; 52/592.5; 52/592.6

[58] Field of Search ..... 52/233, 536, 425, 52/592.6, 592.4, 592.5; 446/106

[56] References Cited

U.S. PATENT DOCUMENTS

| | | | |
|---|---|---|---|
| 1,610,933 | 12/1926 | Daniels . | |
| 1,654,120 | 12/1927 | Ewing . | |
| 1,915,711 | 6/1933 | Adams . | |
| 1,942,348 | 1/1934 | Ward . | |
| 2,005,921 | 6/1935 | Reither . | |
| 2,021,341 | 11/1935 | Ward . | |
| 2,040,110 | 5/1936 | Tahvonen et al. . | |
| 2,110,787 | 3/1938 | Brandjord . | |
| 2,130,231 | 9/1938 | Forciea . | |
| 2,227,878 | 1/1941 | Crooks | 52/592.4 X |
| 2,402,876 | 6/1946 | Dennis . | |
| 2,525,659 | 10/1950 | Edson et al. . | |
| 3,189,950 | 6/1965 | Johnson . | |
| 3,440,784 | 4/1969 | Onjukka | 52/592.5 X |
| 3,473,277 | 10/1969 | Straight | 52/592.6 X |
| 3,517,471 | 6/1970 | Lindmark . | |
| 3,552,079 | 1/1971 | Mortensen | 52/592.6 |
| 4,126,977 | 11/1978 | Chisum . | |
| 4,147,000 | 4/1979 | Lewandowski . | |
| 4,219,977 | 9/1980 | Bene et al. . | |
| 4,279,108 | 7/1981 | Collister, Jr. . | |
| 4,344,263 | 8/1982 | Farmont . | |
| 4,356,676 | 11/1982 | Hauptman . | |
| 4,599,837 | 7/1986 | Wrightman . | |
| 4,627,204 | 12/1986 | Smith . | |
| 4,649,683 | 3/1987 | Dolata . | |
| 4,878,328 | 11/1989 | Berge . | |
| 4,901,489 | 2/1990 | Garber . | |
| 4,903,447 | 2/1990 | McDade . | |
| 4,951,435 | 8/1990 | Beckedorf . | |
| 5,020,289 | 6/1991 | Wrightman . | |
| 5,060,432 | 10/1991 | Christian . | |
| 5,199,239 | 4/1993 | Younger . | |
| 5,787,675 | 8/1998 | Futngi . | |

FOREIGN PATENT DOCUMENTS

| | | | |
|---|---|---|---|
| 25420 A1 | 3/1981 | European Pat. Off. | 52/592.4 |

*Primary Examiner*—Beth A. Stephan
*Assistant Examiner*—Brian E. Glessner
*Attorney, Agent, or Firm*—Thomas Hooker, P.C.

[57] ABSTRACT

Wooden log walls are constructed from full or siding logs stacked one above the other. The logs engage each other at connecting portions including an interior loose tongue and groove joint and downwardly curved cylindrical load supporting surfaces extending to the outer sides of the logs.

17 Claims, 3 Drawing Sheets

INTERFITTING WOODEN AND LOG WALLS

FIELD OF THE INVENTION

The invention relates to wooden logs and wooden log walls used in log structures.

BACKGROUND OF THE INVENTION

Logs are used to construct walls of log houses and other log buildings. The logs form a sturdy and aesthetically pleasing structure. In some types of log construction, full logs are used to form a log wall. Full logs are exposed on both sides of the wall. In other types of log construction, siding logs are used to form a simulated log wall. Siding logs are attached to the exterior of a wall panel and give the appearance of full logs on one side of the wall. In both constructions, connecting portions join adjacent logs when assembled vertically one above the other.

It is important that water be prevented from gaining entry between the logs of a log wall. Water leaking through the wall into the building can cause interior damage. Water trapped between the logs can cause deterioration of the logs. The trapped water may freeze, spreading the logs and allowing more water to enter.

In a known seal between adjacent logs in a log wall, the logs contact each other along curved bearing surfaces at the outer edges of the logs. The bearing surfaces in adjacent logs rest on each other. When an upper log is placed on a lower log during construction of the wall, the bearing surfaces of the upper log press down on the bearing surfaces of the lower log to form joints. The logs must be in exact alignment to permit proper engagement between the bearing surfaces. In practice, the logs are hard to align and fit together. Slight bowing or warpage of the logs after milling of the connecting portions can prevent proper engagement of adjacent logs.

During the lifetime of a log wall constructed with the known seal, the logs may dry, weather, shrink and twist. The logs may separate and allow water to enter into between the logs.

Thus, there is a need for an improved watertight seal between adjacent logs of a log wall. The seal should extend over a substantial width of the log to prevent leaks. The seal should be usable with either full log or siding logs and should permit proper engagement between logs despite bowing or warpage.

SUMMARY OF THE INVENTION

Improved wooden full logs, siding logs and log walls formed from full logs or siding logs are disclosed. The logs have matching downwardly cylindrical bearing surfaces which support adjacent logs. Each bearing surface extends from a loose interior joint between the logs downwardly and outwardly to the outer sides of the logs. When an upper log is placed on a lower log, the curved bearing surfaces flush engage one another to bear and support the upper log on the lower log. The weight of the upper log presses the curved bearing surfaces together to form a reliable large area seal which prevents water from entering between the logs. The loose joint permits proper engagement between the logs despite bowing or warping. After assembly, the improved seal retains its ability to seal the logs after drying or weathering of the logs. The joint is preferably a loose tongue and groove connection with a wide, low tongue on the lower log extending loosely into a wide, shallow groove in the upper log.

The tongue and groove joints between adjacent logs permit limited movement of the upper log on the lower log to facilitate proper fitting of the logs together with flush engagement between the load bearing surfaces. The sides of the tongue and of the groove are outwardly tapered to ease fitting the logs together.

The tongue of each lower log fits loosely up into the groove of each upper log. The tongues and grooves are preferably sized so that the tongue and groove do not touch and a narrow slot extends around the tongue so that the entire weight of the log is carried on the bearing surfaces. The top surface of the low, shallow tongue is curved and lies on or nearly on the circumference of the log. This construction provides an attractive appearance simulating a round log at the corners of the log building where the ends of the logs are exposed.

Sealant recesses are provided at the sides of the groove of each full log inwardly from the exposed side of the log and at the inner edge of each bearing surface. A single sealant recess is provided in a siding log. The sealant recesses extend the full length of the logs. A flowable sealant, which may be a butyl adhesive, is flowed into each sealant recess prior to fitting of the log on a lower log during construction of a log wall to form a weather proof and insulating seal between the two logs, extending the length of the logs. Excess sealant may flow into the narrow slot between the tongue and groove.

Other objects and features of the invention will become apparent as the description proceeds, especially when taken in conjunction with the accompanying drawings illustrating the invention, of which there are three sheets and two embodiments.

DESCRIPTION OF THE PREFERRED EMBODIMENTS

Figure 1:
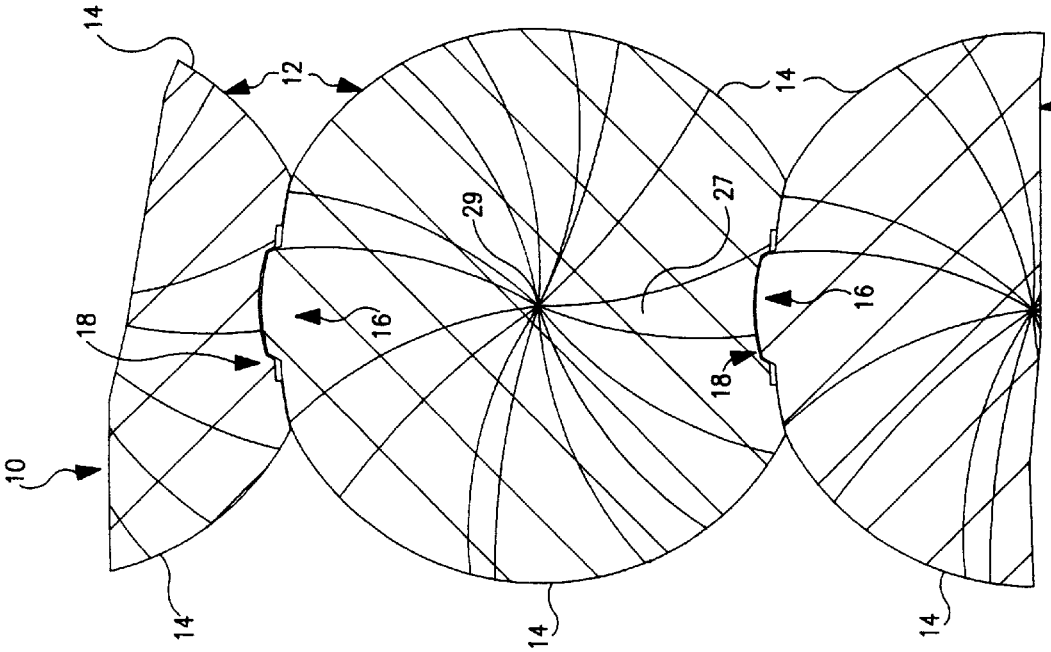
Figure 4:
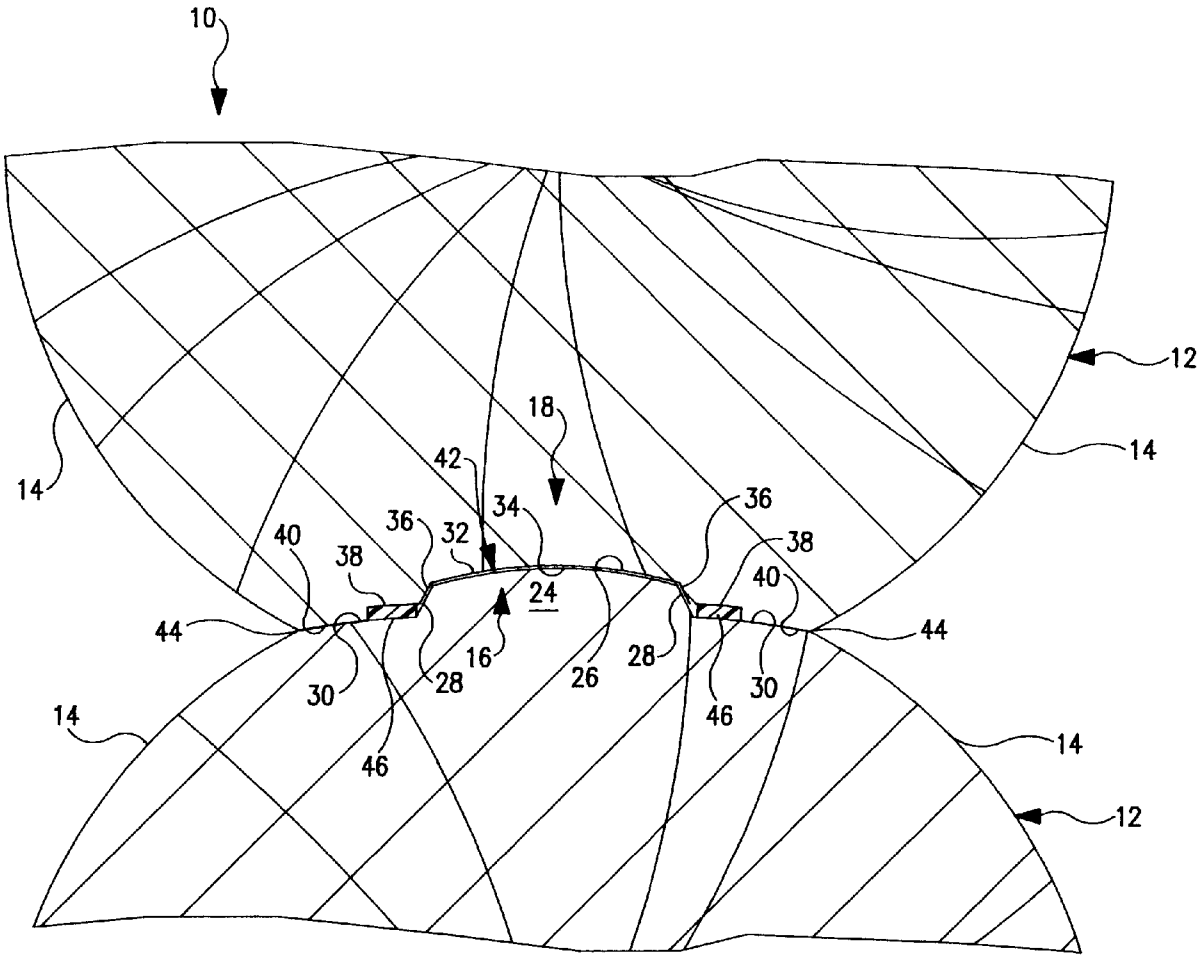
FIG. 4 is an enlarged view of the connection between two adjacent full logs of the wall shown in FIG. 1.

FIGS. 1 and 4 illustrate a first embodiment wooden log wall 10 formed from a number of horizontal full logs 12 stacked vertically on top of each other. Each log 12 includes opposed outer curved sides 14, an upper connecting portion 16 at the top of the log and a lower connecting portion 18 at the bottom of the log. Logs 12 have approximately the same radius and give wall 10 an even and uniform appearance. The logs may be turned to the same diameter. Alternatively, the logs 12 may be graded so that each log has a diameter within a given tolerance in order to form a log wall having like logs arranged along the height of the wall.

Figure 3:
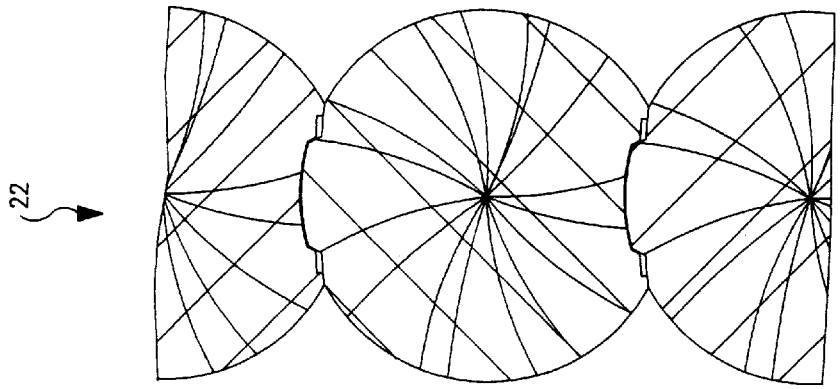
FIGS. 1–3 are vertical sectional views of first embodiment log walls formed from full logs of different diameters.
Figure 2:
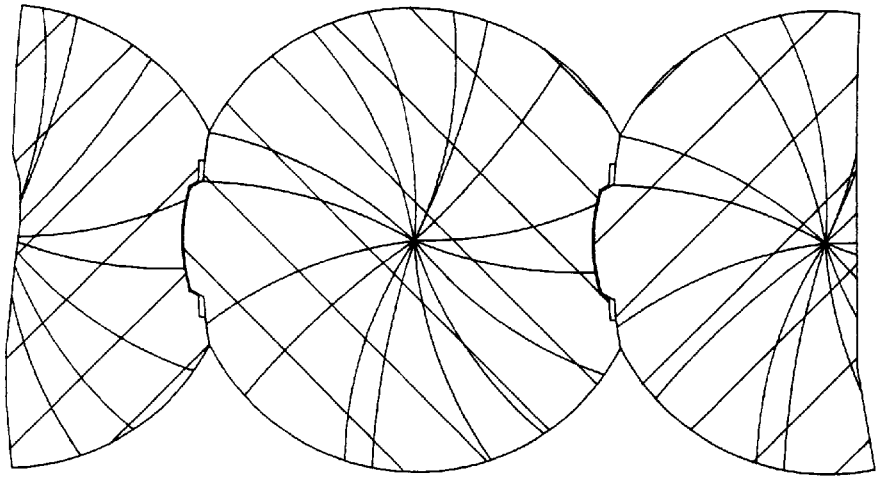

FIGS. 2 and 3 are sectional views taken through log walls 20 and 22 respectively, similar to log wall 10. The logs used in walls 20 have a smaller radius than logs 12 used in wall 10. The logs used in wall 22 have a radius smaller than the logs in used wall 20. The logs in walls 20 and 22 include inner and outer curved sides, like sides 14 of the logs in wall 10, and are provided with upper and lower connecting portions like the upper connecting portion 16 and lower connecting portion 18 of logs 12 in walls 10.

FIG. 4 illustrates the upper and lower connecting portions between two logs 12. The upper connecting portion 16 of each log 12 includes a central upwardly extending wide and low 24 tongue at the top of the log running along the length of the log. The tongue has a wide semi-cylindrical top surface 26 and a pair of short outwardly angled side flanks or walls 28 extending downwardly toward the log 12 from the sides of the top surface. The tongue has a width about four times its height. The radius of top surface 26 is approximately the same as the radius of the log 12. The radii of the top surfaces of the tongues in the logs of wall 22 are also approximately equal to the radii of the logs. For all three walls, the top surfaces of the tongues lie on, or approximately on, the cylindrical surfaces of the logs.

In wall 10, upwardly facing cylindrical load supporting surfaces 30 extend outwardly and downwardly from the lower ends of tongue flanks 28 to the outer log sides 14. The load supporting surfaces run along the length of the logs 12, are cylindrical, have a common axis 27 and a radius greater than the radius of the logs. The axis 27 is located below the axis 29 of the logs. See FIG. 1. The corresponding cylindrical load supporting surfaces in the logs forming walls 20 and 22 also have a radii greater than the radii of the logs used in the walls and common axies. The tongue flanks and the support surfaces of each log are inside the outer circumference of the log.

The lower connecting portion 18 of each log 12 includes a wide shallow groove 32 having a wide cylindrical bottom surface 34 and a pair of relatively short outwardly angled flanks or walls 36 which diverge from the sides of the bottom wall. The width of the groove is about four times its depth. Seal recesses 38 run along the length of each log 12 at the outer ends of the flanks 36. Downwardly facing cylindrical load support surfaces 40 extend outwardly from the seal recesses to junctions with the outer curved sides 14 of logs 12. The radii of surfaces 40 is about the same as the radii of surfaces 30 and is greater than the radius of the logs 12 forming wall 10. The cylindrical surfaces have a common axis.

When logs 12 are stacked together to form wall 10, an upper log is placed on top of a lower log with the connecting portions engaged as shown in FIG. 4. Tongue 24 is fitted into groove 32 and load supporting surfaces 30 and 40 to either side of the tongue and groove rest flush on each other as illustrated. The large area flush contact between the two spaced load supporting surfaces assures a stable connection between the adjacent logs and promotes stability along the height of wall 10. As illustrated, the tongue 24 is spaced a short distance from the groove 32 providing a narrow slot 42 between the tongue and groove. The clearance or slot 42 assures that the load supporting surfaces 30 and 40 bear the weight of the wall, which is not carried by the tongue and groove. Slot 42 also accommodates bowing and warping of the logs. As illustrated, the outer ends of the load supporting surfaces 30 and 40 end at nip 44 defined by the intersections of the outer curved sides 14 of the two logs 12. The nips 44 extend regularly along the length of the wall 10, providing a desired uniform wall with horizontally extending logs and tight uniform horizontal joints between adjacent logs at nips 44.

Prior to assembly of adjacent logs 12 a resilient sealant 46 is placed in the seal recesses 38 extending along the length of the uppermost log 12. The two logs are then fitted together. The outwardly angle flank walls in the tongue and groove facilitate aligning the upper log properly relative to the lower log and then lowering of the upper log onto the lower log to assure the flush engagement between the upwardly and downwardly facing load support surfaces and formation of tight joints between the logs.

Logs 12 are milled to form the tongues, grooves and load supporting surfaces. Milling of the logs is usually performed well prior to the time when the logs are assembled to form a wall or log structure. During the interval, the logs are exposed to the atmosphere and may bow or warp. Bowing or warping of the logs displaces the tongue, groove and supporting surfaces from the milled locations on the logs. The wide tongues and grooves, with outwardly angled flanks, facilitate fitting adjacent logs together properly, despite bowing or warping. An upper log is lowered onto the lower log and the groove at the bottom of the upper log is piloted onto the upwardly extending tongue of the lower log. The width of the top of the tongue is less than the width of the bottom of the groove, which facilitates initial engagement between the tongue and groove. The upper log is then lowered onto the lower log along the length of the log with the groove moved freely onto the tongue. Bowing or warpage of the upper log may require slight rotation of the upper log about the lower log for proper fitment. The upper log is rotated on the cylindrical load supporting surfaces, which have a common axis 27. This rotation is accommodated by the loose tongue and groove joint between the logs. The drawings illustrate tongue 24 loosely fitted centrally within groove 32. In practice, the tongue may be positioned closer to one side of the groove than the other side, due to warpage. The cylindrical load support surfaces maintain flush engagement between the logs.

When the upper log is in place on the lower log the sealant 46, which may be a butyl compound, is compressed between the two logs and forms a tight moisture-impervious seal between the logs. Excess sealant may extend into the ends of the slot 42. The downwardly curved flush load support surfaces 30 and 40 assure that moisture in the interface between the logs gravity drains down and out of the interface. Drainage of moisture helps to assure a long useful life for wall 10.

Figure 5:
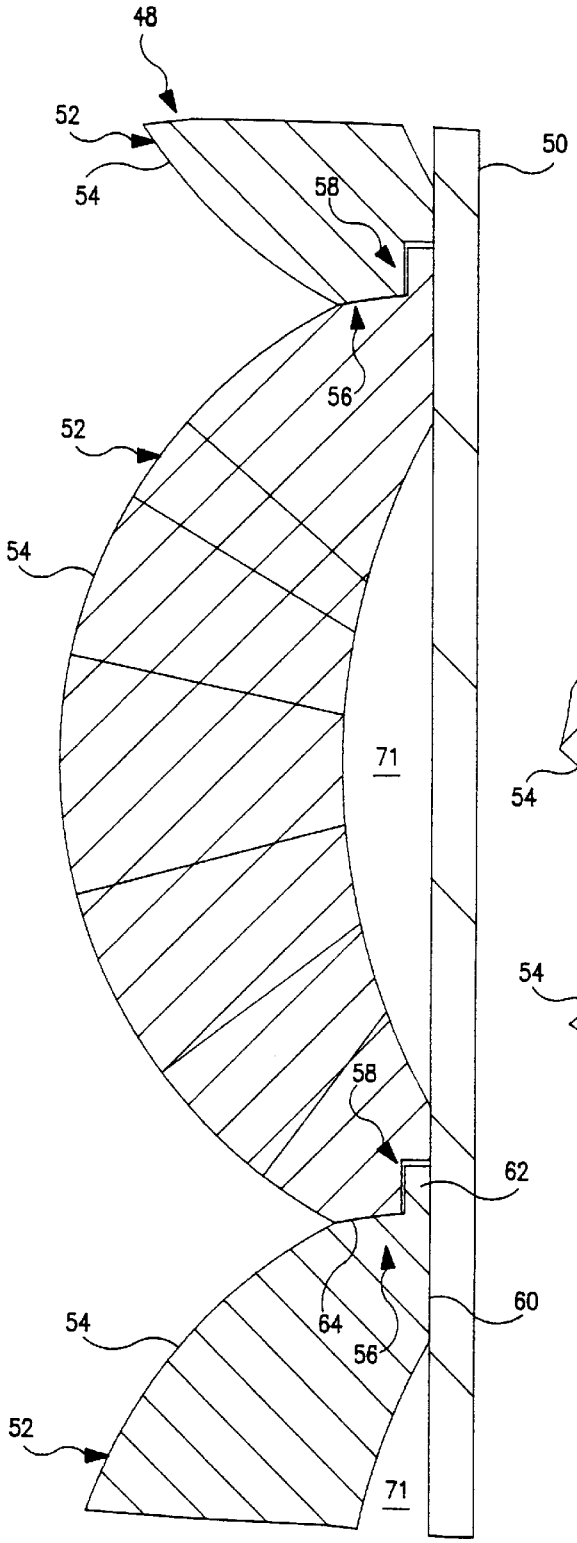
FIG. 5 is a vertical sectional view of a portion of a second embodiment log wall formed from siding logs.
Figure 6:
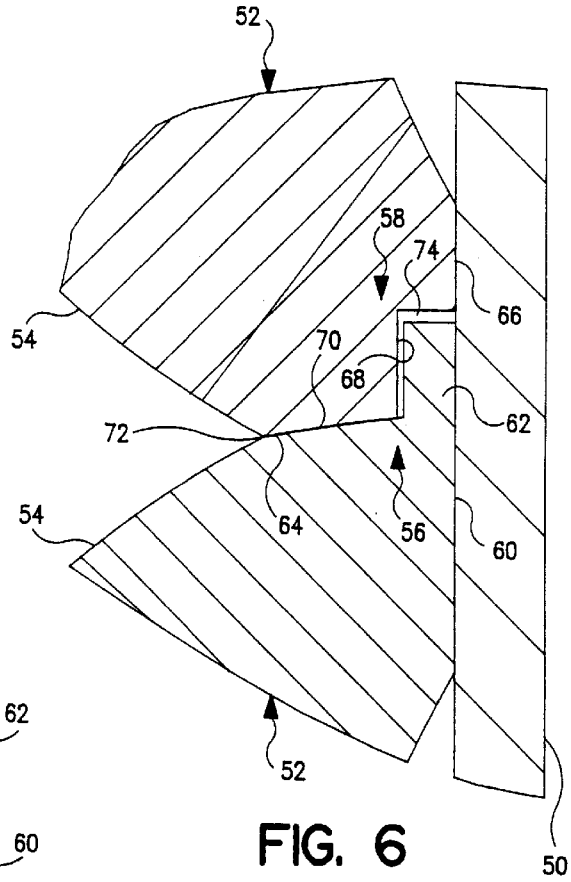
FIG. 6 is an enlarged view of the connection between two adjacent siding logs of the log wall shown in FIG. 3.

FIGS. 5 and 6 illustrate a second embodiment of the invention. Wooden log wall 48 includes a flat support panel 50 and a number of horizontal siding logs 52 secured to panel 50. The logs 52 may be sawed from cylindrical wooden logs. Each log 52 includes an outer curved side 54, like sides 14, an upper connecting portion 56 and lower connecting portion 58. Each upper connecting portion includes a flat upper mounting surface 60 secured to panel 50 and facing inwardly, away from outer curved side 54, an upwardly extending tongue 62 at the upper end of surface 60 and an upwardly facing cylindrical load support surface 64 extending from the bottom of the tongue 50 out and down to curved side 54.

The lower connecting portion 58 includes a flat mounting surface 66 secured to panel 50 and a groove 68 below surface 66. A cylindrical load support surface 70 faces downwardly and extends from the lower end of groove 68 to the outer curved side 54 of the log. Surface 70 has the same shape as surface 64. The load supporting surfaces permit adjacent logs 52 to be rotated relative to each other so that wall 48 may be assembled on a nonplanar panel 50 while retaining flush engagement between surfaces 64 and 70.

The back of each log 52 is hollowed out to provide a concave recess 71 extending between surfaces 60 and 66. The recess removes wood from the log to avoid or reduce warping of the top and bottom of the siding section away from the panel 50. If desired, the recess 71 may be filled with insulation.

Logs 52 are mounted on panel 50 by nails, screws or other mounting members. The way in which the logs are mounted on panel 50 forms no part of the present invention.

Wall 48 is constructed by first mounting the bottom log 52 on the panel 50. Butyl sealant, like sealant 46, is flowed into the groove 58 of the next log 52 and the log is positioned on top of the lower segment as illustrated with the tongue 62 of the lower log extending into groove 68. The sealant is not shown in FIGS. 5 and 6. The load support surfaces 64 and 70 are in flush engagement as illustrated in FIG. 6 defining a horizontal nip 72 which extends along the length of the wall parallel to the adjacent logs 52. As illustrated, a narrow slot 74 is provided between the tongue 62 and groove 68 to accommodate the sealant, accommodate expansion and contraction at the joint and permit relative rotation of the logs. The flush downwardly sloping load supporting surfaces 64 and 70 assure that moisture captured between the adjacent segments gravity flows out from between the logs.

While I have illustrated and described a preferred embodiment of my invention, it is understood that this is capable of modification, and I therefore do not wish to be limited to the precise details set forth, but desire to avail ourselves of such changes and alterations as fall within the purview of the following claims.

What I claim as my invention is:

1. A wooden log wall including a lower log having a first outer curved side and an upper connecting portion, an upper log positioned on and extending along the length of the lower log, said upper log having a first outer curved side above the first outer curved side of the lower log and a lower connecting portion, said outer sides joining at a nip between the logs, said upper connecting portion including a tongue and said lower connecting portion including a groove, said tongue and groove located inwardly from and above the nip, said tongue being narrower than the groove and extending loosely into the groove, and a flush, load supporting interface between the logs defined by a downwardly facing and cylindrical load supporting surface on the upper log extending along the length of the upper log and inwardly from the nip to the groove and an upwardly facing and cylindrical load supporting surface on the lower log extending along the length of the lower log and inwardly from the nip to the tongue, the upwardly facing surface conforming to the downwardly facing surface, said surfaces engaging each other in flush contact outwardly and downwardly from the tongue and groove to the nip and along the length of the logs whereby the logs may rotate with respect to each other along the cylindrical load supporting interface.

2. A wooden log wall as in claim 1 wherein each log includes a second outer curved side.

3. A wooden log wall as in claim 1 wherein said tongue has a curved upper surface lying essentially on the circumference of the lower log.

4. A wooden log wall as in claim 1 where both logs are generally cylindrical and have a first radius, and the supporting surfaces have the same radius, such radius being greater than the first radius.

5. A wooden log wall as in claim 1 wherein each log includes coplanar mounting surfaces at the top and bottom of the log facing away from said first side.

6. A wooden log wall as in claim 5 wherein each log includes a recess formed in the log between the mounting surfaces.

7. A wooden log wall as in claim 6 wherein insulation is included in each log recess.

8. A wooden log of the type used to construct a log wall having a number of like logs stacked horizontally on top of each other, said log having an upwardly facing tongue extending along the length of the log at the top of the log, a downwardly opening groove extending along the length of the log at the bottom of the log, said groove being wider than the tongue, a first outwardly curved side extending along the length of the log between the tongue and the groove, said first outer side being generally cylindrical and having a radius $R_1$ and a first horizontal axis extending along the length of the log and located between the tongue and the groove, the radius $R_1$ defining a circumference and the tongue not extending beyond the circumference, a first upwardly facing load supporting surface extending from the top of the first side to the tongue along the length of the log, such upwardly Lacing load supporting surface being generally cylindrical and having a radius $R_2$ and a second horizontal axis extending along the length of the log and located below said first axis, and a first downwardly facing load supporting surface extending from the bottom of the first side to the groove along the length of the log, such downwardly facing load supporting surface being generally cylindrical and having a radius $R_3$ and a third axis extending along the log and located below the log, radius $R_1$ being smaller than radius $R_2$ and radius $R_2$ equaling radius $R_3$, the upwardly facing load supporting surface being convex and the downwardly facing load supporting surface being concave, wherein when the log is stacked against a like log in a wall the tongue of the lower log extends into the groove of the upper log and the upwardly and downwardly facing load supporting surfaces of the logs are in flush engagement with each other to permit rotational shifting of adjacent logs along the load supporting surfaces.

9. A wooden log as in claim 8 wherein the top of the tongue lies on the circumference of said curved side.

10. A wooden log as in claim 9 including a seal recess extending along the length of the log at one side of the downwardly facing load supporting surface.

11. A wooden log as in claim 8 wherein said log is generally cylindrical and including a second outwardly curved side across from the first outer curved side extending between the tongue and groove.

12. A wooden log as in claim 11 including a second upwardly facing load supporting surface extending from the top of the second side to the tongue along the length of the log, such second upwardly facing surface being generally cylindrical and having a radius $R_4$ equal to $R_2$ and said second horizontal axis, and a second downwardly facing load supporting surface extending from the bottom of the second side to the groove along the length of the log, such second downwardly facing load supporting surface being generally cylindrical and having a radius $R_5$ equal to $R_3$ and said third axis.

13. A wooden log as in claim 12 including seal recesses between the groove and the downwardly facing load supporting surfaces.

14. A wooden log as in claim 8 including mounting surfaces at the top and bottom of the log facing away from said first side.

15. A wooden log as in claim 14 wherein said mounting surfaces are coplanar.

16. A wooden log as in claim 15 including a recess formed in the log between said mounting surfaces.

17. A wooden log as in claim 16 including insulation in the recess.

* * * * *

UNITED STATES PATENT AND TRADEMARK OFFICE

CERTIFICATE OF CORRECTION

PATENT NO. : 6,070,376
DATED : June 6, 2000
INVENTOR(S) : William D. Asper

It is certified that error appears in the above-indentified patent and that said Letters Patent is hereby corrected as shown below:

Title page, item [54] and col. 1, after "WOODEN" insert --LOGS--.

Claim 8, line 16, replace "Lacing" with --facing--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*